US006014790A

United States Patent [19]

Smith et al.

[11] Patent Number: 6,014,790

[45] Date of Patent: Jan. 18, 2000

[54] DUCTWORK CLEANING SYSTEM

[76] Inventors: David A. Smith, 14755 Lochinvar Dr., Dallas, Tex. 75240; John D. Crutcher, 636 Lexington St., Dunedin, Fla. 34698

[21] Appl. No.: 09/126,510

[22] Filed: Jul. 30, 1998

[51] Int. Cl.[7] ..... A47L 5/36

[52] U.S. Cl. ..... 15/304; 15/302; 15/321; 15/353; 96/243; 261/118

[58] Field of Search ..... 15/302, 314, 321, 15/304, 353; 96/273, 277, 280; 261/118

[56] References Cited

U.S. PATENT DOCUMENTS

| | | | |
|---|---|---|---|
| 983,293 | 2/1911 | Kundig-Honegger | 15/353 |
| 1,363,860 | 12/1920 | Fetters et al. | 15/353 X |
| 3,485,671 | 12/1969 | Stephens | 15/304 X |
| 3,572,264 | 3/1971 | Mercer | 96/280 X |
| 3,894,851 | 7/1975 | Gorman | 261/118 X |
| 4,872,920 | 10/1989 | Flynn et al. | 15/321 X |
| 4,947,515 | 8/1990 | Ivarsson | 15/401 |
| 5,021,095 | 6/1991 | Tamaki | 15/321 X |
| 5,072,487 | 12/1991 | Walton | 15/304 X |

*Primary Examiner*—Chris K. Moore
*Attorney, Agent, or Firm*—Lieberman & Nowak, LLP

[57] ABSTRACT

A system for cleaning building ductwork utilizing the equipment generally used to clean carpets. The system utilizes the vacuum unit and liquid waste tank from a carpet cleaning system. A flexible hose runs between the waste tank and the building ductwork. A water injection system is connected to the hose and is used to spray a stream of water into the air flowing through the flexible ductwork which will entrap any particles contained therein. The "dirty" water flowing out of the hose will flow to the waste tank for collection and disposal.

6 Claims, 2 Drawing Sheets

DUCTWORK CLEANING SYSTEM

BACKGROUND AND SUMMARY OF THE INVENTION

This invention is directed to a system for cleaning ductwork and particularly to a system for cleaning ductwork with equipment generally used to clean carpets.

The ductwork comprising a commercial and/or residential building's heating and airconditioning system can become contaminated with dust, dirt and even disease carrying particles. The debris in a duct may cause the occupants of a building to become ill (so-called "sick building" syndrome). Accordingly, it is desirable that the building ductwork be cleaned on a regular basis. Specialized equipment has been designed to be connected to the ductwork and vacuum the system to remove and trap any particles which are contaminating the ductwork. However, such equipment is specialized and can be relatively expensive.

Carpet cleaning systems and their associated equipment are quite common and are used in many locations. These systems, both portable and truck mounted, utilize a vacuum unit which is used to extract a liquid cleaning solution which is applied to the carpet, vacuumed off the carpet, and drained into a liquid waste tank. It would be desirable if the vacuum system of carpet cleaning equipment could also be used to clean ductwork. However, the vacuum unit of a carpet cleaning system cannot be directly connected to building ductwork as the dust and particles that are removed from the ductwork will damage the impellers of the carpet cleaning vacuum unit. The present invention provides a means to utilize carpet cleaning equipment to clean building ductwork without damaging the equipment or allowing harmful particles to get into the air..

The present invention is directed to a system for cleaning building ductwork utilizing the equipment used to clean carpets. In the system, the vacuum unit and liquid waste tank of a carpet cleaning system are used in their normal manner. A flexible vacuum hose runs between the building ductwork and the carpet cleaning unit including a fluid waste tank system. The vacuum unit of the carpet cleaning extractor is used to create a vacuum so as to draw the dirt and particles out of the ductwork. Attached to the hose running between the building ductwork and the liquid waste tank is a liquid injector system which sprays a liquid (generally water) into the vacuum line from the building. The dirt and particles carried in the line will mix with the water and be pulled into the waste tank for removal. As the particles have become trapped in the water, no particles will reach the vacuum system of the carpet cleaning system and therefore cannot damage it or allow harmful particles back in the air. The present invention can be used to clean all types of ductwork ("flex duct", "tin duct" and insulated duct) and can be implemented on both portable and truck mounted carpet cleaning systems.

BRIEF DESCRIPTION OF THE DRAWINGS

For a better understanding of the invention, a reference is had to the following drawings, in which.

DESCRIPTION OF THE PREFERRED EMBODIMENT

Figure 1:
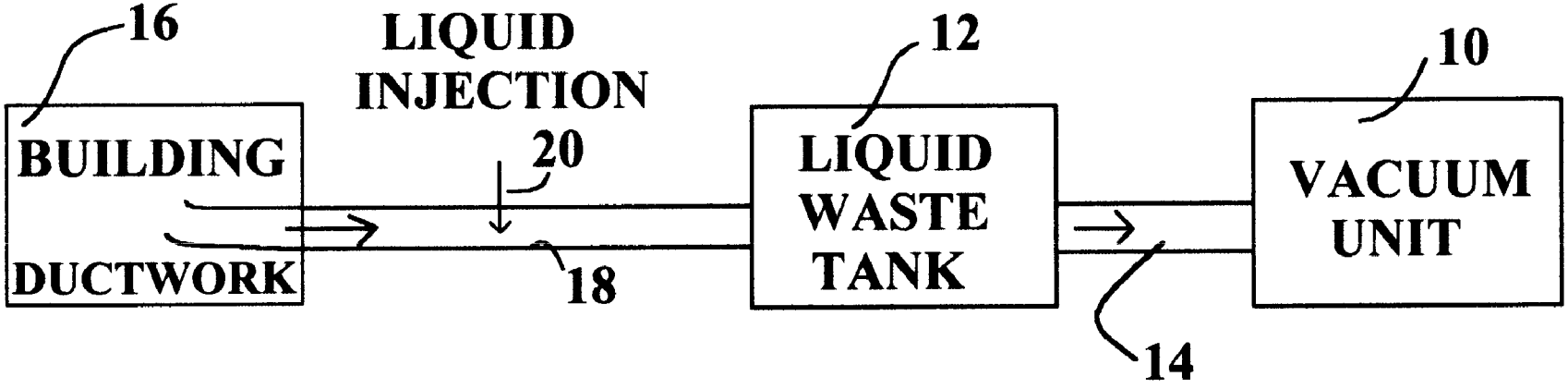
FIG. 1 illustrates an overview of a ductwork cleaning system utilizing the equipment of a standard carpet cleaning system.

FIG. 1 illustrates the present system that permits building ductwork to be cleaned using the equipment generally associated with a carpet cleaning system. The system includes a vacuum unit 10 and a liquid waste tank 12 which are of the type generally associated with carpet cleaning units (extractors). Vacuum unit 10 contains a motor and impeller for creating a vacuum and is connected to liquid waste tank 12 by a vacuum line 14. When used as a carpet cleaning system the liquid cleaning solution applied and removed from the carpet is passed by a hose to waste tank 12 under the action of vacuum unit 10. Waste tank 12 and vacuum system 10 require no modifications from those used with a carpet cleaning system.

In order to clean building ductwork 16, a vacuum hose 18 runs between ductwork 16 and waste tank 12. The end of vacuum hose 18 extending to and into ductwork 16 may include a brush or other cleaning implement. The vacuum from vacuum unit 10 will be applied through hose 18 to building ductwork 16 and will cause any dust, dirt, and contaminating particles to be drawn into hose 18. Attached to hose 18 is a liquid injection system 20 which is used to spray a stream of liquid (which is generally water or the soapy solution used to clean carpets) into hose 18. The spray of liquid into the airstream flowing within hose 18 will entrap the dust, dirt and particles removed from building ductwork 16. The "dirty water" from hose 18 will flow into liquid waste tank 12 and be collected in the usual fashion.

Figure 2:
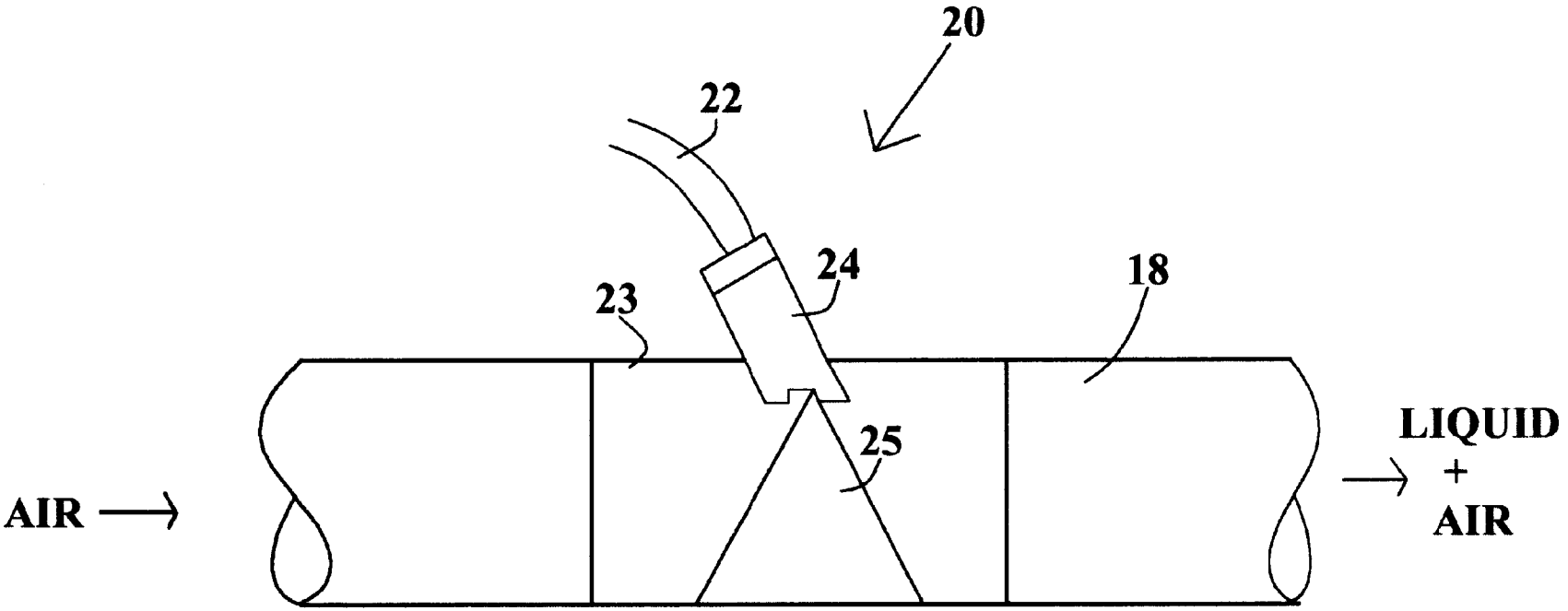
FIG. 2 shows the details of the water injection system of the present invention.

FIG. 2 illustrates in detail liquid injection system 20 as connected to hose 18. Liquid injection system 20 includes a hose 22 attached to a supply of liquid (not shown). Joined to hose 22 is a collar 23 and a nozzle 24 which extends within hose 18. Nozzle 24 is arranged to provide a spray of liquid 25 to intercept the air flowing into hose 18 and to entrap any particles drawn from the building ductwork. Thus, air from the building ductwork 16 containing the removed particles will flow into hose 18 and a mixture of air and dirty liquid containing the particles removed from the airstream will flow out of hose 18 and into waste tank 12 for a subsequent disposal. It is thus seen that the present system provides the capability of cleaning building ductwork with a standard carpet cleaning system.

The foregoing merely illustrates the principles of the present invention. Those skilled in the art will be able to devise various modifications, which although not explicitly described or shown herein, embody the principles of the invention and are thus within its spirit and scope.

What is claimed is:

1. A system for cleaning building ductwork comprising:

a. means for supplying a vacuum;

b. a liquid waste tank coupled to the vacuum supply means;

c. a vacuum hose running between the liquid waste tank and the building ductwork to be cleaned; and d. means for injecting a spray of liquid into said vacuum hose so as to wet any particles flowing within said vacuum hose to permit the wet particles to be trapped within said liquid waste tank.

2. The cleaning system as claimed in claim 1 wherein the means for injecting the spray of liquid includes a nozzle disposed within the vacuum hose.

3. The cleaning system as claimed in claim 1 wherein the liquid that is injected includes water.

4. The cleaning system as claimed in claim 1 wherein the vacuum supply means and liquid waste tank comprises the vacuum unit and liquid waste tank of a carpet cleaning system.

5. In a device for cleaning carpets having a vacuum unit and a liquid waste tank wherein the improvement comprises apparatus for cleaning building ductwork, said building ductwork cleaning apparatus including 1) a flexible hose running between the building ductwork and the liquid waste tank; and 2) liquid injection means connected to said flexible hose for injection of a liquid into said flexible hose so as to entrap any particles flowing through said hose so that they may be trapped by the liquid waste tank.

6. The device as claimed in claim 5, wherein the liquid that is injected is water.

* * * * *